US005809467A

United States Patent [19]

Otsuka et al.

[11] Patent Number: 5,809,467

[45] Date of Patent: Sep. 15, 1998

[54] DOCUMENT INPUTTING METHOD AND APPARATUS AND SPEECH OUTPUTTING APPARATUS

[75] Inventors: Mitsuru Otsuka; Yasunori Ohora; Takashi Aso, all of Yokohama; Toshiyuki Noguchi, Tokyo; Toshiaki Fukada, Yokohama, all of Japan

[73] Assignee: Canon Kabushiki Kaisha, Tokyo, Japan

[21] Appl. No.: 923,939

[22] Filed: Sep. 5, 1997

Related U.S. Application Data

[63] Continuation of Ser. No. 596,540, Feb. 5, 1996, abandoned, which is a continuation of Ser. No. 172,376, Dec. 22, 1993, abandoned.

[30] Foreign Application Priority Data

Dec. 25, 1992 [JP] Japan ..... 4-345864

[51] Int. Cl.[6] ..... G10L 5/02

[52] U.S. Cl. ..... 704/260; 704/201; 704/258

[58] Field of Search ..... 704/258, 260, 704/201

[56] References Cited

U.S. PATENT DOCUMENTS

| | | | |
|---|---|---|---|
| 4,969,194 | 11/1990 | Ezawa | 395/2.85 |
| 4,975,957 | 12/1990 | Ichikawa et al. | 381/36 |
| 5,142,657 | 8/1992 | Ezawa et al. | 381/48 |
| 5,163,111 | 11/1992 | Baji et al. | 395/22 |
| 5,220,629 | 6/1993 | Kosaka et al. | 381/52 |
| 5,393,236 | 2/1995 | Blackmer et al. | 434/169 |

FOREIGN PATENT DOCUMENTS

| | | |
|---|---|---|
| 09171392A | 12/1995 | Japan . |
| 09305193A | 5/1996 | Japan . |

OTHER PUBLICATIONS

Shimizu et al., "The control of the prosodic features fro the Japanese speech synthesis system by rule editing functions," Journal of the Acoustical Society of Japan, vol. 45, No. 6, pp. 434–440 Jun. 1985.

Hubacher, "Bondwell 12–mature 8–bit technology," Mikro–und Kleincomputer, vol. 7, No. 3, pp. 17–19 Jun. 1985.

*Primary Examiner*—Tariq R. Hafiz

*Attorney, Agent, or Firm*—Fitzpatrick, Cella, Harper & Scinto

[57] ABSTRACT

A document inputting apparatus or speech outputting apparatus inputs and displays document data, specifies accent information, pronunciation information and syllable-length information of words or characters of the document data. The apparatus displays the document data in accordance with the specified information so that information such as the accent positions or accent intensities can be recognized. Thus formed document data is stored in a memory with the accent information, the pronunciation information or the syllable-length information. Upon reading the document data from the memory and outputting it as speech, the specified information is referred to for speech synthesizing, thus outputting speech corresponding to the correct pronunciation.

44 Claims, 12 Drawing Sheets

FIG. 33

SEEING IS TO BELIEVING

FIG. 34

SEEING IS TO BELIEVING

FIG. 35

SEEING IS TO BELIEVING

FIG. 36

SEEING IS TO BELIEVING

DOCUMENT INPUTTING METHOD AND APPARATUS AND SPEECH OUTPUTTING APPARATUS

This application is a continuation of application Ser No. 08/596,540 filed Feb. 5, 1996, which in turn is a continuation of application Ser. No. 08/172,376, filed Dec. 22, 1993, both of which are now abandoned.

BACKGROUND OF THE INVENTION

The present invention relates to a document inputting method and apparatus and, more particularly, to a document inputting method and apparatus for inputting document information and displaying the input information, and to a speech outputting apparatus for outputting the input document data in the form of speech. Upon inputting document information, the document inputting method and apparatus input the accent position of a word included in the document information, reading the KANA (Japanese syllabary) representation of KANJI characters (Chinese character)), or syllable-length information to pronounce the word.

Recently, outputting document information by performing speech synthesis has been in great demand. However, document information, inputted by conventional word-processors, only consists of character codes, and lacks information for speech synthesizing. For example, in a Japanese word-processing system, document information is inputted using, e.g., a KANA-KANJI conversion function. Each character code is merely designated as a KANJI character, a HIRAGANA character (the cursive KANA character) or the like. To output such document information as speech, information on the accent of each word, information on reading of the word, further, information on the syllable-length of the corresponding spoken word are required. Generally, in a case where data indicative of the accent of a word is inputted, the position of an accent core (a syllable immediately before the accent begins to fall) is inputted using numeral(s). For example, for a flat-intonation type word (e.g. ringo), "0" is inputted.

Upon inputting the reading of a KANJI character in a Japanese KANJI-and-KANA document, the same reading often corresponds to different KANJI characters of different pronunciations. For example, reading "こうり(kouri)" corresponds to both "小売" and "公理", which are pronounced in different ways; the pronunciation of "小売" is [kouri], while the pronunciation of "公理" is [kɔ:ri].

In English, the different meanings of a word (spelling) are often pronounced differently. "refuse" has the pronunciation [rifju':z] when it means "to show unwillingness to do"; it has the pronunciation [re'fju:s] when it means "a worthless part of something".

Accordingly, in an English document, spelling and corresponding pronunciation should be correlated to each other for speech synthesizing.

SUMMARY OF THE INVENTION

The present invention has been made in consideration of the above situation, and has as its object to provide a document inputting method and apparatus for designating the accent of each word or phrase.

It is another object of the present invention to provide a document inputting method and apparatus for recognizably displaying the accent position of a word included in document data in accordance with the designated accent of the word.

It is a further object of the present invention to provide a document inputting method and apparatus for recognizably displaying the accent intensity of a designated accent.

It is a further object of the present invention to provide the document inputting method and apparatus for specifying of the actual pronunciation of each word or character.

It is a further object of the present invention to provide a document inputting method and apparatus for specifying the syllable-length of each character.

It is a further object of the present invention to provide a document inputting method and apparatus for specifying the meaning of document data by clarifying the accent position.

It is a further object of the present invention to provide a document inputting method and apparatus for specifying the meaning of document data by specifying the actual reading of each word or character.

It is a further object of the present invention to provide a speech outputting apparatus for outputting document data via speech by clarifying the accent positions thereof.

It is a further object of the present invention to provide a speech outputting apparatus for specifying the actual reading of each word or character and outputting document data in via speech in accordance with the designated readings.

It is a further object of the present invention to provide a speech outputting apparatus for specifying the syllable-length of each character and outputting document data via speech in accordance with the designated syllable-lengths.

Other objects and advantages besides those discussed above shall be apparent to those skilled in the art from the description of a preferred embodiment of the invention which follows. In the description, reference is made to the accompanying drawings, which form a part thereof, and which illustrate an example of the invention. Such an example, however, is not exhaustive of the various embodiments of the invention, and therefore reference is made to the claims which follow the description for determining the scope of the invention.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 33 to 36 respectively illustrate a display example of syllable-length inputting according to a modification to the third embodiment.

DETAILED DESCRIPTION OF THE PREFERRED EMBODIMENTS

Preferred embodiments of the present invention will be described in detail in accordance with the accompanying drawings.

<First Embodiment>

Figure 1:
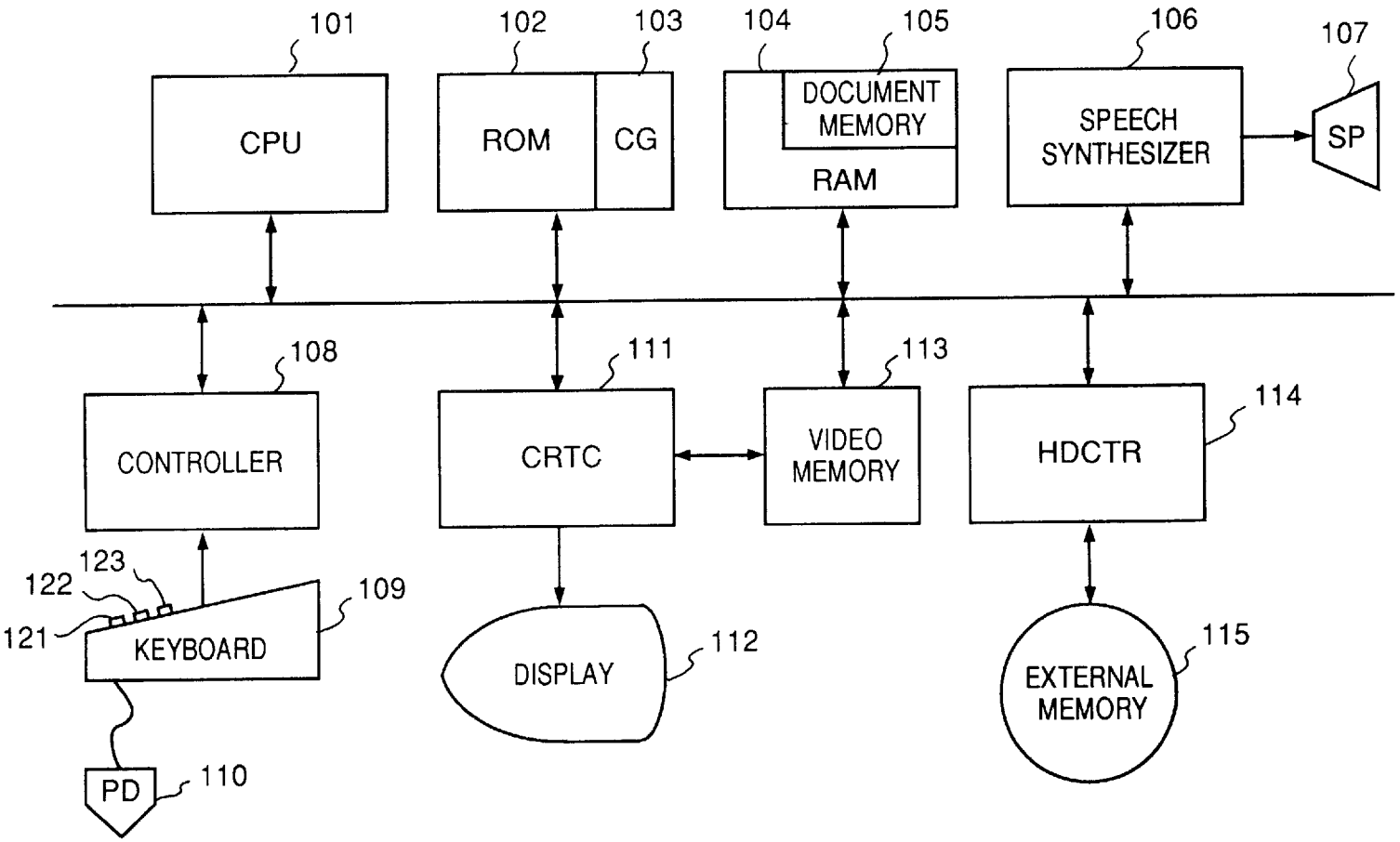
FIG. 1 is a block diagram showing the configuration of a document processing apparatus according to the first embodiment of the present invention.

FIG. 1 shows the configuration of a document processing apparatus according to the first embodiment of the present invention. The apparatus has a function of converting document data, inputted from an external device such as a keyboard and a hard disk, to speech information and outputting speech.

Figure 2:
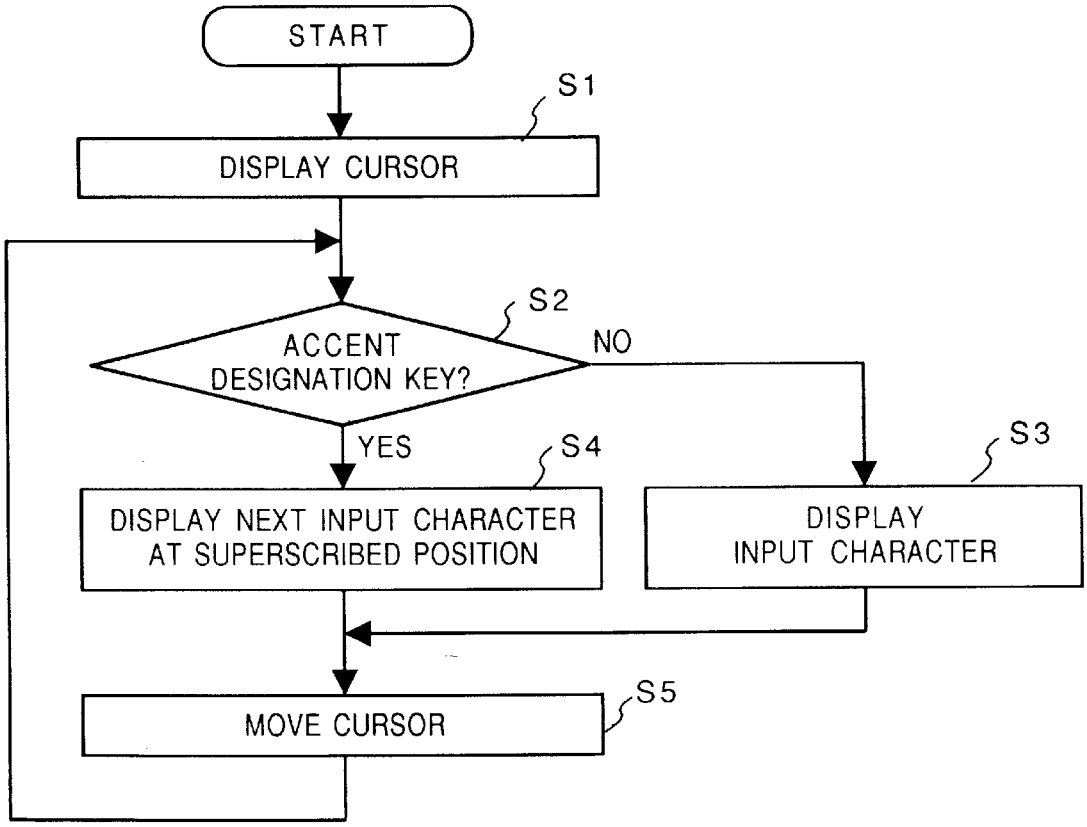
FIG. 2 is a flowchart showing accent inputting according to the first embodiment.

In FIG. 1, reference numeral 101 denotes a CPU (central processing unit) for controlling the overall apparatus. The CPU 101 performs various control operations in accordance with control programs stored in a ROM (read only memory) 102. The processing to be described with reference to FIG. 2 is also performed by the CPU 101 in accordance with a control program in ROM 102. The ROM 102 has a character generator (CG) 103 for storing character patterns respectively corresponding to character codes and a data area for storing various data as well as the area for the programs. Note that the program area may be in a RAM (random access memory) for loading a necessary control program from an external memory 115. Numeral 104 denotes a RAM, used as a work area for the CPU 101, for storing accent information, reading information and syllable-length information, which will be described later, in correspondence with input document data or each character/word of the document data. Numeral 106 denotes a speech synthesizer for converting document data, stored in a document memory 105 of the RAM 104, to speech information in accordance with accent information, reading information further, length information, and for outputting the converted data as audible sound through a speaker 107.

Numeral 109 denotes a keyboard for inputting document data or various instructions; and numeral 110 denotes a pointing device (PD) such as a mouse and a digitizer. The information inputted by the keyboard 109 and/or the PD 110 enters the CPU 101 under the control of a controller 108. Numeral 121 denotes an accent-input designation key for designating the inputting of an accent; 122 denotes a reading-input designation key for designating the inputting of reading; 123 denotes a syllable-length-input designation key for designating the inputting of the syllable length; 112 denotes a display, e.g., a CRT or a plasma display; 111 denotes a controller (CRTC) for controlling the displaying on the display 112; 113 denotes a video memory for storing data to be displayed on the display 112; 115 denotes an external memory such as a hard disk or a floppy disk; 114 denotes a controller (HDCTR) for controlling the reading/writing of data from/to the external memory 115.

In the above construction, document data from the keyboard 109 or the external memory 115 is stored in the document memory 105, and at the same time, the CG 103 converts character code included in the document data to a character pattern and the display 112 displays the pattern. An operator moves a cursor on the screen using the keyboard 109 or the PD 110 to point to a desired character or word, and designates the inputting of an accent, reading information or a syllable-length. Thereafter, the operator instructs outputting of the document data as speech. The document data, the accent information, the reading information and the syllable-length information of each character in the document data, stored in the RAM 104, are outputted to the speech synthesizer 106, which converts the character codes of the document data to speech information. The resulting speech is outputted from the speaker 107.

FIG. 2 shows the accent inputting operation in the document processing apparatus of the present embodiment. The control program for performing this processing is stored in the ROM 102. Note that in this embodiment, the inputting of an accent, the reading or designation of an accent, the reading or designation of the syllable length is performed while document data is inputted; however, as described above, the specifying of the accent, the reading or designation of the syllable length can be performed on already-input document data. FIGS. 3 to 8 shows a display example on the display 112 of the accent inputting operation according to the first embodiment, which will be described below with reference to FIGS. 3 to 8.

Figure 3:
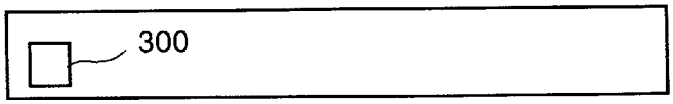
FIGS. 3 to 8 illustrate a display example of the accent inputting according to the first embodiment.
Figure 4:
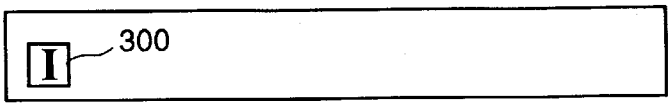
Figure 5:
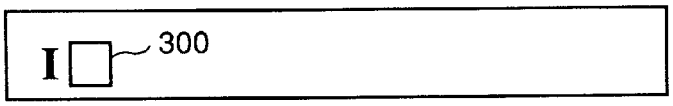

In step S1, a cursor 300 is displayed on the displayed line as shown in FIG. 3. Next, in step S2, whether the accent-input designation key 121 is pressed or not is determined. If NO, the process proceeds to step S3. As shown in FIG. 4, character "I" is inputted, and a character corresponding to an input character code is displayed within the cursor 300. In step S5, as shown in FIG. 5, the cursor 300 moves to the next character input position, and a code indicative of a space is inputted.

Figure 6:
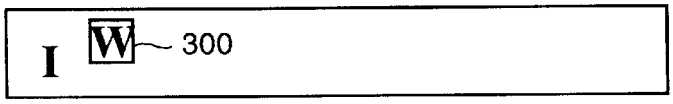
Figure 7:
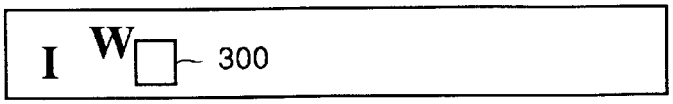
Figure 8:
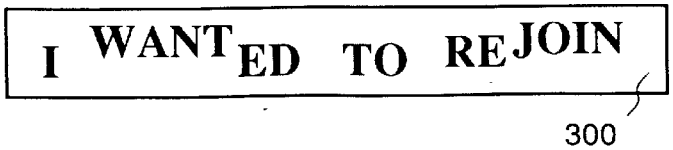

Thereafter, when the accent-input designation key 121 is pressed in step S2, the process proceeds to step S4, in which a character corresponding to the next input character code ("W") is displayed. As shown in FIG. 6, the character is positioned higher than the "I" character. Accent information corresponding to this character is stored in the RAM 104. As shown in FIG. 7, the cursor 300 moves to the next character position in step S5. Thereafter, the process returns to step S2 to repeat the above operation. FIG. 8 shows the result of the processing.

In FIG. 8, the elevated characters correspond to accented characters, thus enabling easy confirmation of the accent position.

Next, a modification to the first embodiment will be described below.

Figure 9:
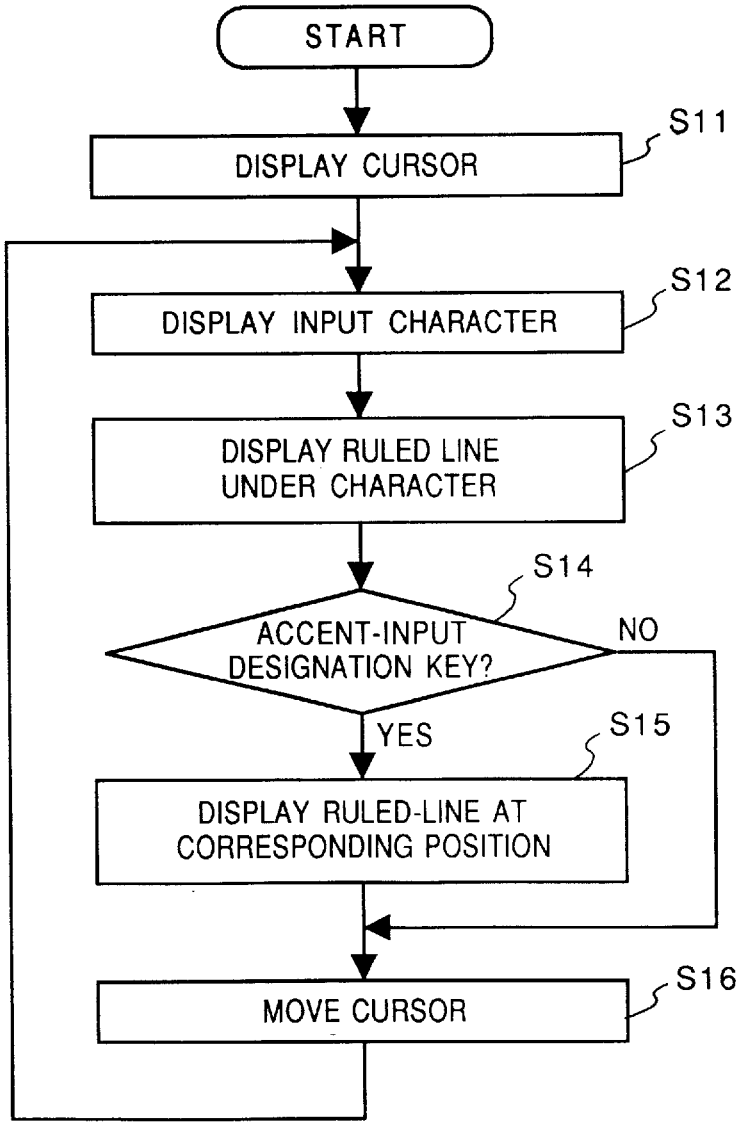
FIG. 9 is a flowchart showing a modification to the first embodiment.

FIG. 9 shows the accent designation operation in the document processing apparatus using the modification. FIGS. 10 to 15 show a display example on the display 112, according to the modification. Note that the control program for performing this processing operation is also stored in the ROM 102.

Figure 10:
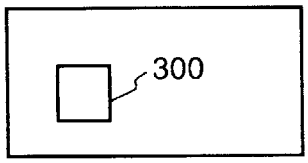
FIGS. 10 to 16 illustrate another display example of the accent inputting according to the first embodiment.
Figure 11:
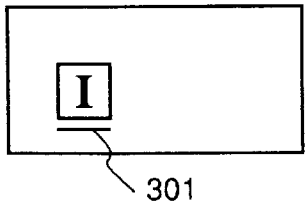

In step S11, a pattern of the cursor 300 is stored in an area of the video memory 113, and the cursor 300 is displayed on the display 112, as shown in FIG. 10. In step S12, when a character code is inputted from the keyboard 109, the CG 103 is referred to and a character pattern corresponding to the character code is generated. The generated pattern 301 is stored in the video memory 113. As shown in FIG. 11, a character corresponding to the input character "I" is displayed within the cursor 300. In step S13, a line pattern is stored in the video memory 113 so that the line is displayed under the displayed character. Thus, the input character and the line under the character are displayed as shown in FIG. 11.

Next, in step S14, whether the accent-input designation key 121 of the keyboard 109 is pressed or not is determined.

Figure 12:
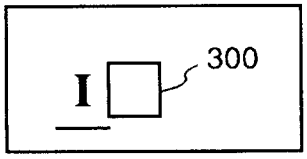
Figure 13:
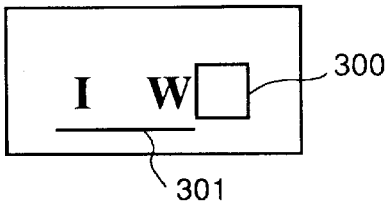

If NO, the process proceeds to step S16 to move the cursor 300 to the next character position as shown in FIG. 12, and returns to step S12.

Figure 14:
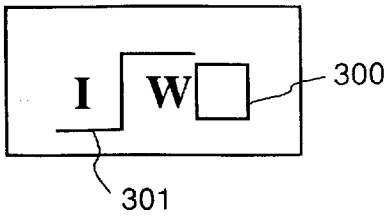
Figure 15:
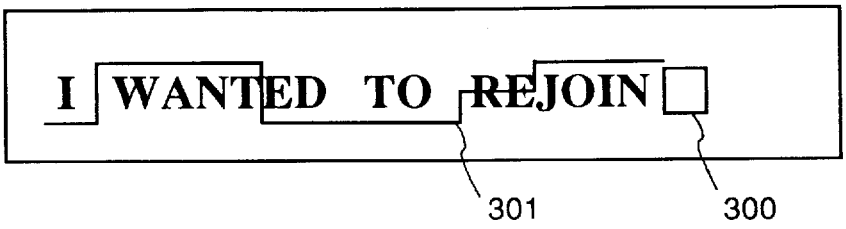

On the other hand, if the accent designation key 121 is pressed in step S14, the process proceeds to step S15 in which accent information inputted using e.g. ten keys of the keyboard 109 is stored in the RAM 104. This accent information is not binary information showing whether or not an accent is designated, but information specifying accent intensity. In step S15, the line pattern 301 under the character "W" (FIG. 13) is deleted, and as shown in FIG. 14, the line pattern 301 is displayed at a position corresponding to the accent intensity inputted in step S14 and stored in the RAM 104. In step S16, the cursor 300 moves to the next character position. Thereafter, the process returns step S12 to repeat the above operation. FIG. 15 shows the result of inputting the sentence "I WANTED TO REJOIN".

It should be noted that in the first and second embodiments, accent-input designation is made using the key 121 of the keyboard 109; however, the present invention is not limited to using key 121 for accent-input designation. The accent-input designation can be made using other keys and switches, e.g., a key-button of the PD 110.

Figure 16:
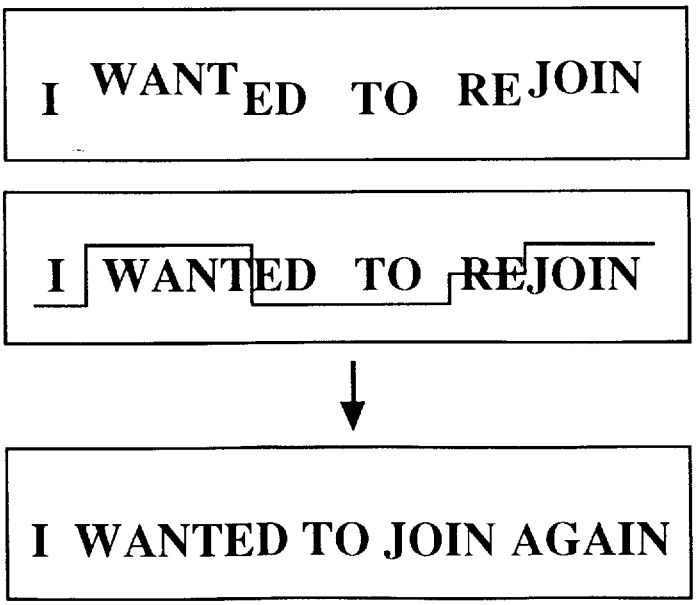

In FIG. 16, the verb "REJOIN" has several meanings, such as "to answer the replication of the plaintiff" and "to join again". The embodiment enables one to specify the meaning of the "REJOIN" by specifying the accent position, and further to replace the sentence with "I WANTED TO JOIN AGAIN".

As described above, according to the first embodiment, specifying the accent position (and accent intensity) of each character in an input document data results in visually displaying the accent of the document.

Further, the thus-formed document data can be used for speech synthesizing.

In addition, the meaning of the document can be specified exactly.

<Second Embodiment>

Next, the process of inputting the reading of each KANJI character or word of document data will be described as the second embodiment. Note that the document processing apparatus in this embodiment has the same construction as that in FIG. 1, and therefore, the explanation of its construction will be omitted.

Figure 17:
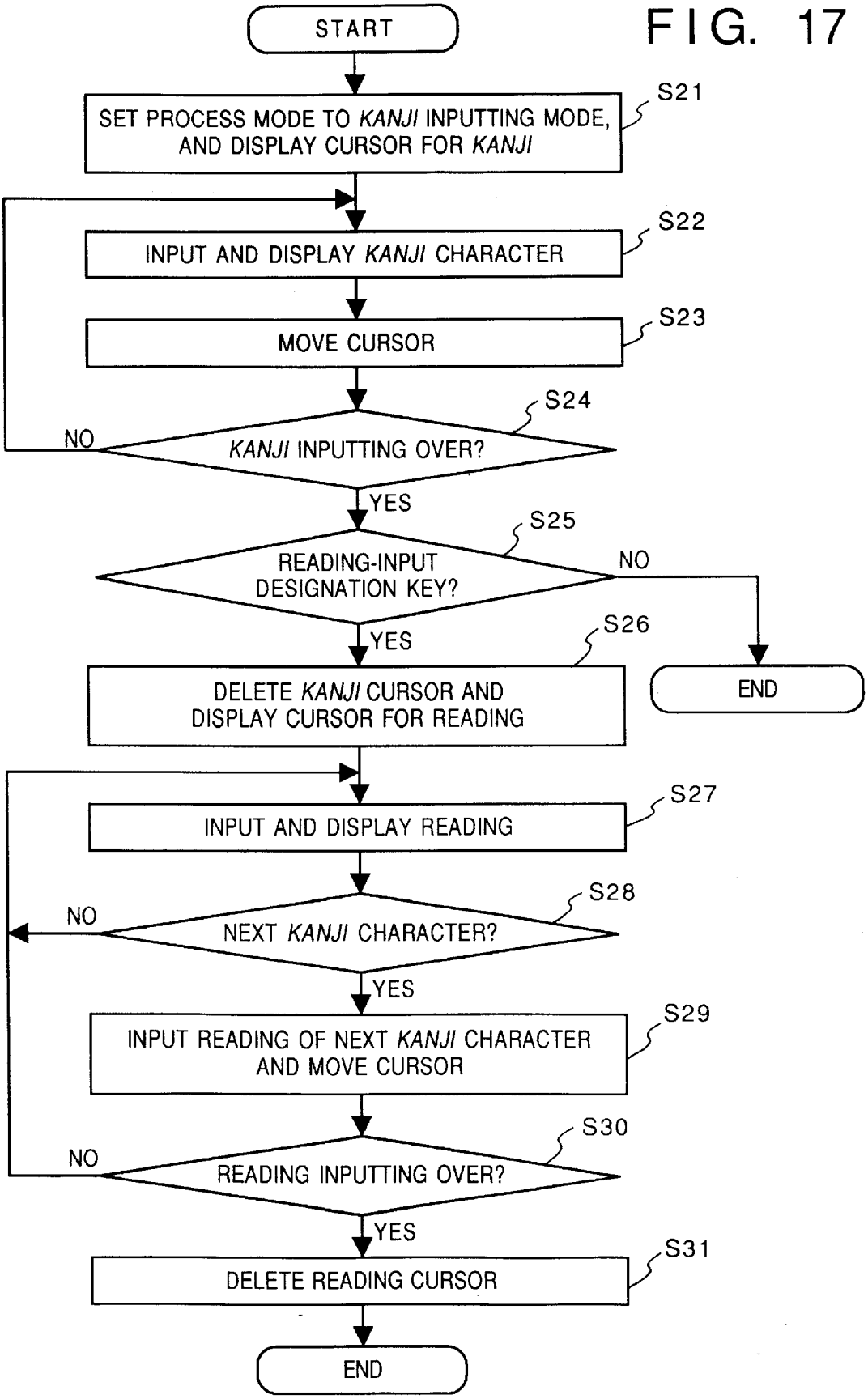
FIG. 17 is a flowchart showing reading inputting according to a second embodiment of the present invention.
Figure 18:
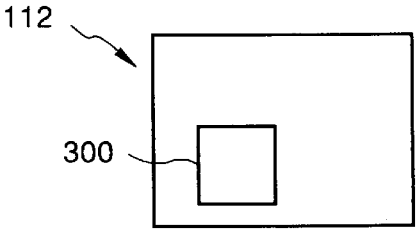
FIGS. 18 to 25 illustrate a display example of the reading inputting according to the second embodiment.

FIG. 17 shows the reading inputting operation according to the second embodiment. The control program for performing this processing is stored in the ROM 102. This processing will be described with reference to FIGS. 18 to 25.

In step S21, the cursor 300 is displayed on the display 112, and the process mode is set to the KANJI inputting mode.

Figure 19:
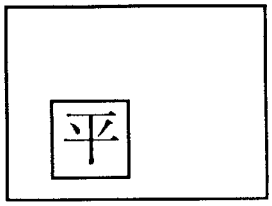
Figure 20:
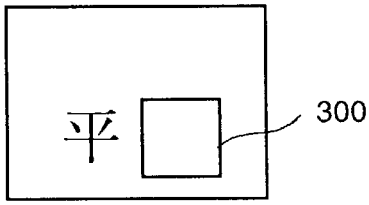

In step S22, KANJI character 平 is inputted using a KANA-KANJI conversion function based on an input character code (FIG. 19). In step S23, the cursor 300 moves to the next input position and waits for input of the next KANJI character, as shown (FIG. 20). In step S24, whether the input operation is completed or not is determined. If another KANJI character or KANA character is inputted, the process returns to step S22 to repeat the above operation.

Figure 21:
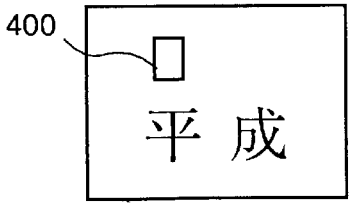

If the inputting operation is over in step S24, whether the reading-input designation key 122 is pressed or not is examined in step S25. If the reading inputting operation is not designated, the process ends. If the reading inputting operation is designated, i.e., the key 122 is pressed, the process proceeds to step S26 in which the cursor 300 is deleted and a cursor 400 for inputting reading data is displayed above the input KANJI character (FIG. 21). As the HIRAGANA character indicating the reading of the KANJI character is inputted from the keyboard 109, the HIRAGANA character is displayed within the cursor 400 as a part of the reading operation.

Figure 22:
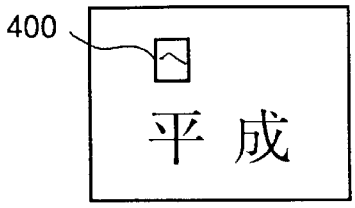
Figure 23:
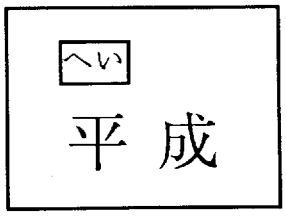

FIG. 22 shows the part "へ (he)" of the reading "へい" of the KANJI character "平". As the reading "へい" is inputted in step S27, the reading is displayed as shown in FIG. 23. In step S28, whether the cursor moves to the next reading input position above the next KANJI character is determined. In this example, as reading "せい" of the next KANJI character "成" is inputted, inputting the reading "せい" is designated by e.g. pressing a tab key of the keyboard 109.

Figure 24:
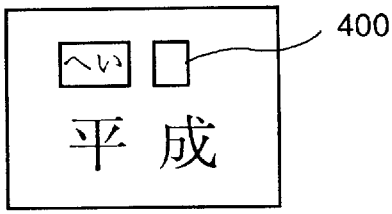
Figure 25:
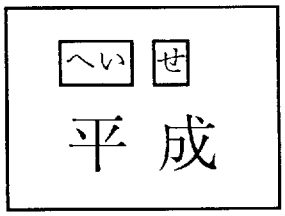

As the next reading input is designated, the cursor 400 is displayed above the next KANJI character "成", as shown in FIG. 24. As the reading "せい" is inputted, the input reading is displayed within the cursor 400, as shown in FIG. 25. Next, in step S30, the termination of the inputting is designated from the keyboard 109 (e.g., the key 122 is pressed again), the process proceeds to step S31, to delete the cursor 400 and the process ends.

Thus-inputted reading information is stored in the RAM 104 corresponding to each KANJI character. As described above, according to the second embodiment, the reading information can be inputted in correspondence with each KANJI character or word, thus correlating reading and actual pronunciation.

Generally, a KANJI character has several readings e.g., the character "平" can be read as "たいら (taira)" or "ひら (hira)". In the second embodiment, the reading of the KANJI character can be specified.

Further, upon converting document data to an audio signal by the speech synthesizer 106 and outputting the audio signal as speech, the correct reading of the document can be confirmed.

In the second embodiment, HIRAGANA characters are used as the reading data, however; KATAKANA characters can also be used as the reading data.

The second embodiment has been described for the case of KANJI character in Japanese document; however, the present invention is not limited to this arrangement. The present invention can also be applied to an English document, where one spelling corresponds to a plurality of different words having different pronunciations. For example, whether the word "lead" is to be pronounced as [li:d] or [led] specifies meaning of the word. When "record" is pronounced as [re'ko:d] it has one meaning and when it is pronounced as [riko':d] it has a different meaning.

Figure 26:
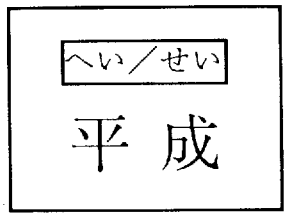
FIG. 26 illustrates a display example of reading inputting according to a modification to the second embodiment.

Further, in the embodiment, the cursor 400 is used to define a border between the reading data of difference letters. However, as shown in FIG. 26, a slash "/" may be used instead to separate reading data.

<Third Embodiment>

Next, a document processing apparatus according to the third embodiment of the present invention will be described with reference to FIG. 27 and the subsequent drawings. Note that the apparatus has the same construction as that in FIG. 1, and therefore, the explanation of its construction will be omitted.

In the document processing apparatus according to the third embodiment, upon outputting speech synthesized with the speech synthesizer based on the document data, the setting of the syllable-length of each character of the document data produces a pronunciation close to the actual pronunciation.

Figure 27:
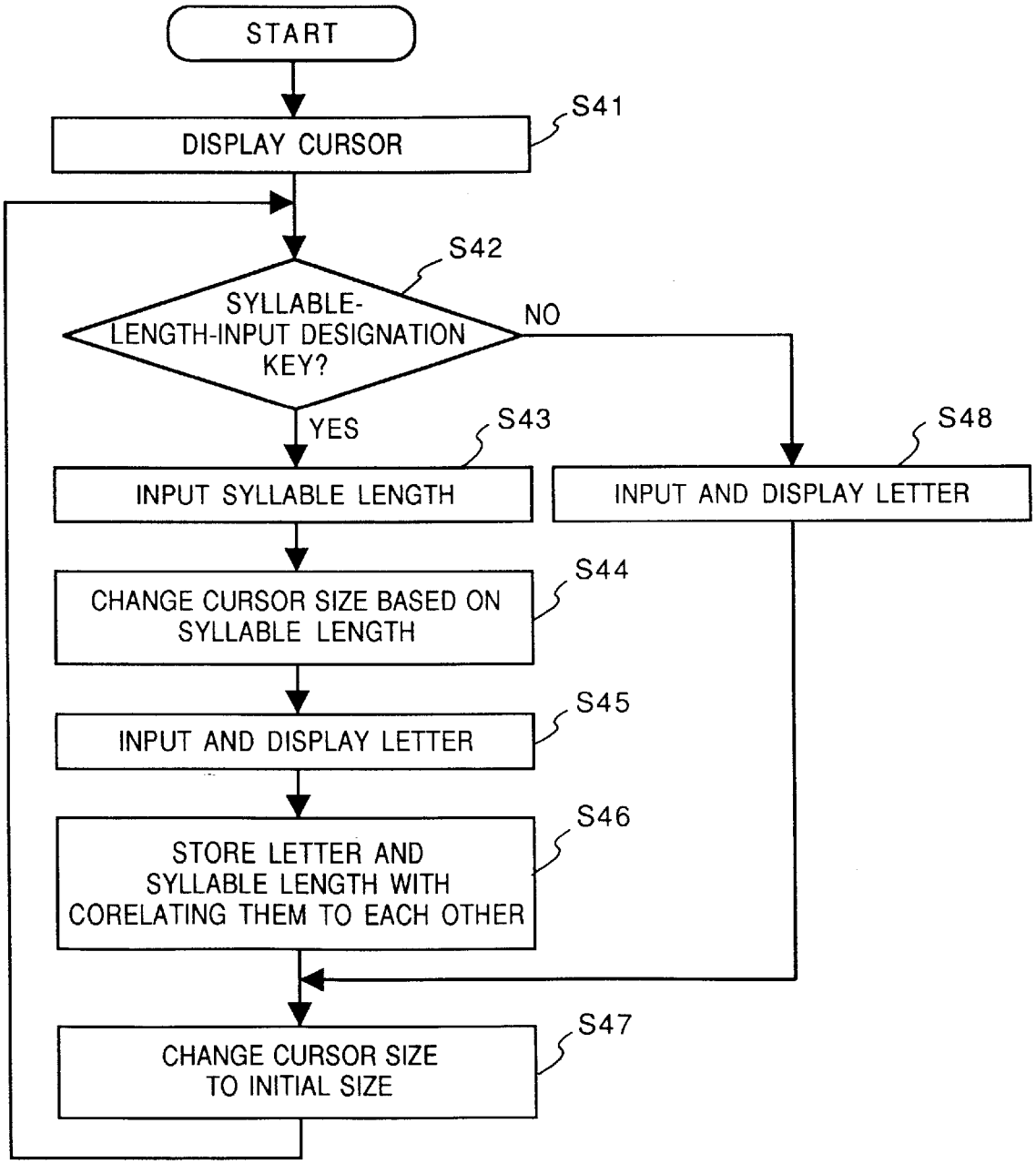
FIG. 27 is a flowchart showing syllable-length inputting according to a third embodiment of the present invention.

FIG. 27 shows the syllable-length inputting operation according to the third embodiment. The control program for performing this processing is stored in the ROM 102.

Figure 28:
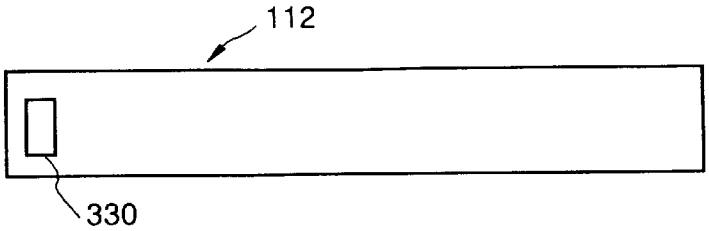
FIGS. 28 to 32 illustrate a display example of syllable-length inputting according to the third embodiment.
Figure 29:
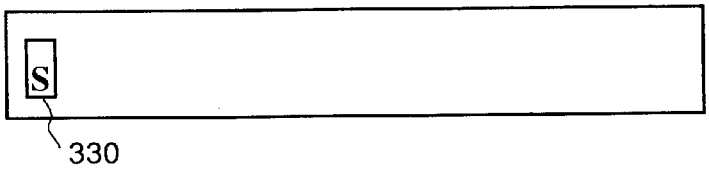
Figure 30:
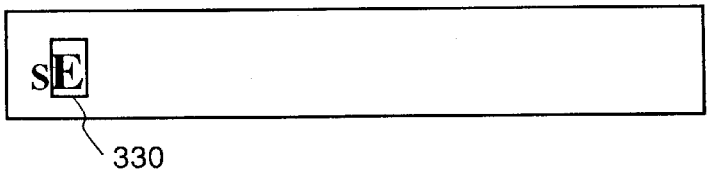

In step S41, a cursor 330 is displayed at a document input area on the display 112 (FIG. 28). In step S42, whether the syllable-length-input designation key 123 is pressed or not is examined. If NO, the process proceeds to step S48, in which when the next character is inputted, the character is displayed within the cursor 330 (FIG. 29). In step S47, the cursor 330 moves to the next character position (FIG. 30).

Figure 31:
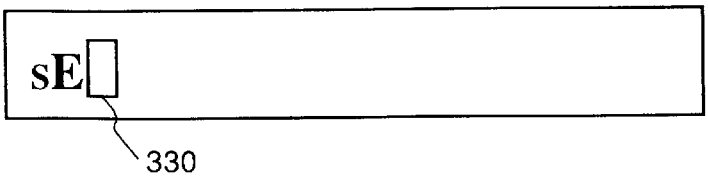
Figure 32:
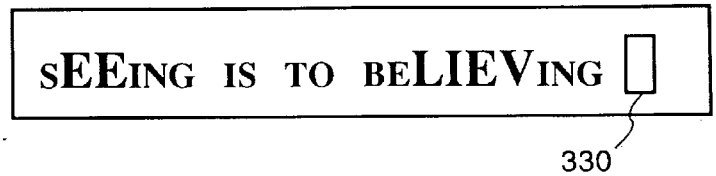

If YES in step S42, the process proceeds to step S43, in which syllable-length information is inputted using the ten keys of the keyboard 109. In step S44, the size of the cursor 330 is changed in accordance with the input syllable-length information. In step S45, an input character is displayed within the cursor 330. At this time, the size of the input character is matched with that of the cursor 330. FIG. 30 shows the displayed character. Next, in step S46, the input character and its syllable-length information are stored in the RAM 104 so that they correlate with each other. In step S47, the size of the cursor 330 is changed to the initial size, and is moved to the next input character position (FIG. 31). The process returns to step S42 to repeat the above operation. FIG. 32 shows thus-inputted sentence "SEEING IS TO BELIEVING".

In this embodiment, the character size is changed based on its syllable length; however, the present invention is not limited to this arrangement. As shown in FIG. 33, the font of accented character can be changed, e.g., to italic to indicate syllable length. As shown in FIG. 34, a dot may be provided above the accented character; as shown in FIG. 35, the accented character may be underlined; and as shown in FIG. 36, the color of the accented character image and the background may be inverted.

As described above, according to the third embodiment, specifying the syllable length of each character in document data and storing the syllable-length information in correspondence with the character enables the synthesizing of speech, by the speech synthesizer 106, with a pronunciation closer to the actual pronunciation than that of conventional synthesized speech.

As described above, the present invention attains the displaying an input character with a visually clear accent and the storing the accent information in correspondence with the character.

Further, the present invention specifies the manner in which each KANJI character is to be read or the actual pronunciation of each word and stores the specified reading or pronunciation in correspondence with the KANJI character or word.

Moreover, the present invention specifies the syllable length of each character and stores syllable-length information in correspondence with the character.

The present invention can be applied to a system constituted by a plurality of devices, or to an apparatus comprising a single device. Furthermore, the invention is applicable also to a case where the object of the invention is attained by supplying a program to a system or apparatus.

Each of the embodiments described above can be separately operated or can be operated together with another embodiment.

As many apparently widely different embodiments of the present invention can be made without departing from the spirit and scope thereof, it is to be understood that the invention is not limited to the specific embodiments thereof except as defined in the appended claims.

What is claimed is:

1. A character inputting and outputting apparatus comprising:

input means for inputting one or more characters;

display means for displaying the characters input by said input means on a screen;

designation means for designating one or more characters, in sequence, among the characters displayed on the screen;

accent input means for inputting accent information indicating accents of the one or more characters designated by designation means and displayed on the screen;

display control means for controlling said display means to display the one or more characters and to visually distinguish the accents of the one or more characters based on the accent information; and memory means for storing the one or more characters with their associated accents; and speech synthesizer means for speech synthesizing the one or more characters, with their associated accents, stored and read out of said memory means to produce an audio output of the one or more characters utilizing their associated accents.

2. The apparatus according to claim 1, wherein said accent input means inputs accent data including data on the position of a character to be accented and an intensity with which the accented character is to be accented.

3. The apparatus according to claim 2, wherein said display control means controls said display means to display the accented character in accordance with the accent intensity.

4. The apparatus according to claim 1, further comprising speech conversion means for reading the characters stored in said memory means and converting the characters to synthesized speech in correspondence with (the) an accent position.

5. The apparatus according to claim 1, further comprising a keyboard for inputting the modification information indicating an accent.

6. The apparatus according to claim 5, wherein said keyboard inputs the modification information indicating an accent to a position designated by a cursor displayed on said display means.

7. The apparatus according to claim 5, wherein said keyboard inputs a character code and the modification information indicating an accent at a position designated by a cursor displayed on said display means.

8. The apparatus according to claim 7, further comprising determination means for determining whether said keyboard inputs the modification information indicating an accent, and control means for controlling said accent input means to set the modification information and for controlling said display means to generate the characters and the accent of the character in accordance with a determination result of said determination means.

9. The apparatus according to claim 1, wherein said designation means includes a keyboard.

10. The apparatus according to claim 1, wherein said display means has a cathode ray tube display unit.

11. The apparatus according to claim 1, wherein said display means has a liquid crystal display unit.

12. A character inputting and outputting apparatus comprising:

input means for inputting one or more characters, including Kanji characters;

display means for displaying the characters inputted by said input means on a screen;

designation means for designating one or more characters, in sequence including Kanji characters, among the characters displayed on the screen;

pronunciation input means for inputting pronunciation information to instruct the apparatus on the pronunciation of the characters designated by designation means;

memory means for storing the one or more characters with their associated pronunciation information; and speech synthesizer means for speech synthesizing the one or more characters, read out of the memory means, using their associated pronunciation information which is also read out of the memory means.

13. The apparatus according to claim 12, wherein said pronunciation input means further inputs data on a separation of the pronunciation information.

14. The apparatus according to claim 12, further comprising speech conversion means for reading the characters stored in said memory means and converting the characters to synthesized speech in correspondence with the inputted pronunciation information.

15. The apparatus according to claim 12, wherein said input means includes a keyboard.

16. The apparatus according to claim 12, wherein said display means has a cathode ray tube display unit.

17. The apparatus according to claim 12, wherein said display means has a liquid crystal display unit.

18. A character inputting and outputting apparatus comprising:

input means for inputting one or more characters;

display means for displaying the characters inputted by said input means on a screen;

designation means for designating one or more characters, in sequence among the characters displayed on the screen;

syllable-length input means for inputting information indicating syllable-length information on the screen, for the one or more characters designated by said designation means;

syllable-length display means for changing the display form of the one or more characters designated by said designation means, for which the syllable-length information is set in accordance with the information inputted by said syllable-length input means;

memory means for storing the one or more characters with their associated syllable-length information; and speech synthesizer means for speech synthesizing the one or more characters, read out of the memory means, using their associated syllable-length information which is also read out of the memory means.

19. The apparatus according to claim 18, wherein said syllable-length display means changes the display form of a character by changing the character size of a character in correspondence with the syllable length information input for the character.

20. The apparatus according to claim 18, wherein said syllable-length display means changes the display form of a character by changing the character font of a character in correspondence with the syllable-length information input for the character.

21. The apparatus according to claim 18, further comprising speech conversion means for reading the characters stored in said memory means and converting the characters to synthesized speech in correspondence with the input syllable-length information.

22. The apparatus according to claim 18, wherein said input means includes a keyboard.

23. The apparatus according to claim 18, wherein said display means has a cathode ray tube display unit.

24. The apparatus according to claim 18, wherein said display means has a liquid crystal display unit.

25. A character inputting and outputting method comprising the steps of:

inputting and displaying one or more characters on a screen;

designating one or more characters, in sequence, among the characters displayed on the screen;

inputting accent information indicting accents of the one or more characters designated in said designating step and displayed on the screen;

displaying the one or more characters and visually distinguishing the accents of the one or more characters on the screen, based on the accent information;

storing the one or more characters, with their associated accent information; and speech synthesizing the one or more characters with their associated accents, and producing audio output of the one or more characters utilizing their associated accents.

26. The method according to claim 25, further comprising a step of visually distinguishing an accent intensity with which the designated character is to be accented based on the accent.

27. The method according to claim 25, further comprising the step of inputting the modification information using a keyboard.

28. The method according to claim 27, wherein said inputting step inputs the modification information to a position designated by a cursor displayed on display means by using the keyboard.

29. The method according to claim 27, wherein said inputting step inputs with the keyboard a character code and the modification information at the position designated by a cursor displayed on display means.

30. The method according to claim 29, further comprising a determination step for determining whether the keyboard inputs the modification information, and a control step for controlling said modification information inputting step to set the modification information and controlling said displaying step to display the document in accordance with a determination result of said determination step.

31. The method according to claim 25, wherein said character inputting step inputs the characters by using a keyboard.

32. The method according to claim 25, wherein said displaying step displays the characters on a cathode ray tube display unit.

33. The method according to claim 25, wherein said displaying step displays the characters on a liquid crystal display unit.

34. A character inputting and outputting method comprising the steps of:

inputting and displaying one or more characters including KANJI characters on a screen;

designating one or more characters in sequence, including KANJI characters among the characters displayed on the screen;

inputting pronunciation information to instruct a character inputting and outputting apparatus on the pronunciation of the characters designated in said designating step;

storing one or more characters with their associated pronunciation information in memory means; and reading out the one or more characters and their associated pronunciation information from the memory means and speech synthesizing the one or more characters using their associated pronunciation information.

35. The method according to claim 34, wherein said inputting step inputs the characters by using a keyboard.

36. The method according to claim 34, further comprising a display step for displaying the characters on a cathode ray tube display unit.

37. The method according to claim 34, further comprising a displaying step for displaying the characters on a liquid crystal display unit.

38. A document inputting program comprising:

a module for inputting and displaying a plurality of characters on a screen;

a module for designating a character in the characters displayed on the screen;

a module for inputting accent information indicating accents of the one or more characters designated by said designating module and displayed on the screen;

a module for displaying the one or more characters and visually distinguishing the accents of the one or more characters based on the accent information;

a module for storing the one or more characters with their associated accents; and a module for reading out the one or more characters and their associated accents stored by said storing module and for speech synthesizing the one or more characters with their associated accents to produce an audio output of the one or more characters utilizing their associated accents.

39. A character inputting and outputting program comprising:

a module for inputting and displaying one or more characters including KANJI characters on a screen;

a module for designating one or more characters, in sequence, including KANJI characters, among the characters displayed on the screen;

a module for inputting pronunciation information to instruct a character inputting and outputting apparatus on the pronunciation of the characters designated by said designating module;

a module for storing the one or more characters with their associated pronunciation information; and a module for reading out the one or more characters and their associated accents stored by said storing module and for speech synthesizing the one or more characters with their associated accents.

40. A character inputting and outputting program comprising:

a module for inputting and displaying one or more characters on a screen;

a module for designating one or more character, in sequence, among the characters displayed on the screen;

a module for inputting information indicating syllable-length information on the screen, for the one or more characters designated by said designating module;

a module for changing the display format of the designated one or more characters which the syllable information is input in accordance with the information input by said information inputting module;

a module for storing the one or more characters with the syllable-length information; and a module for reading out the one or more characters and their associated accents stored by said storing module and for speech synthesizing the one or more characters with their associated accents.

41. A recording medium for storing a character inputting and outputting program comprising:

a module for inputting and displaying one or more characters on a screen;

a module for designating one or more characters, in sequence, among the characters displayed on the screen;

a module for inputting accent information indicating accents of the one or more characters designated by said designating module and displayed on the screen;

a module for displaying the one or more characters and visually distinguishing the accents of the one or more characters based on the accent information;

a module for storing the one or more characters with their associated accents; and a module for reading out the one or more characters and their associated accents stored by said storing module and for speech synthesizing the one or more characters with their associated accents to produce an audio output of the one or more characters utilizing their associated accents.

42. A recording medium for storing a character inputting and outputting program comprising:

a module for inputting and displaying characters including KANJI characters on a screen;

a module for designating one or more characters, in sequence, including KANJI characters, among the characters displayed on the screen;

a module for inputting pronunciation information to instruct a character inputting and outputting apparatus on the pronunciation of the characters designated by said designating module;

a module for storing the one or more characters with their associated pronunciation information; and a module for reading out the one or more characters and their associated accents stored by said storing module and for speech synthesizing the one or more characters with their associated accents.

43. A recording medium for storing a character inputting and outputting program comprising:

a module for inputting and displaying one or more characters on a screen;

a module for designating one or more characters, in sequence, among the characters displayed on the screen;

a module for inputting information indicating syllable-length information on the screen, for the one or more characters designated by said designating module;

a module for changing the display format of the one or more characters designated by said designing module, for which the syllable information is set in accordance with the information input by said information inputting module;

a module for storing the one or more characters with their associated syllable-length information; and a module for reading out the one or more characters and their associated accents stored by said storing module and for speech synthesizing the one or more characters with their associated accents.

44. A character inputting and outputting method comprising the steps of:

inputting and displaying one or more characters on a screen;

designating one or more characters, in sequence, among the characters displayed on the screen;

inputting information indicating syllable-length information on the screen, for the character designated in said designating step;

changing the display format of the character of the one or more characters designated by said designating step, for which the syllable-information is input, in accordance with the syllable-length information;

storing the one or more characters with their associated syllable-length information in memory means; and reading out the one or more characters and their associated syllable-length information from the memory means and speech synthesizing the one or more characters using their associated syllable-length information.

* * * * *

UNITED STATES PATENT AND TRADEMARK OFFICE

CERTIFICATE OF CORRECTION

PATENT NO. : 5,809,467

DATED : September 15, 1998

INVENTOR(S) : MITSURU OTSUKA, ET AL.

It is certified that error appears in the above-identified patent and that said Letters Patent is hereby corrected as shown below:

ON THE COVER PAGE,

AT [56], U.S. PATENT DOCUMENTS

```
Insert--4,685,135  8/87   Lin, et al.........395/2.69
        4,964,167  10/90  Kunizawa, et al....395/2.69
        5,111,409  5/92   Gasper, et al......395/2.69
        5,212,731  5/93   Zimmermann.........395/2.69
        5,278,943  1/94   Gasper, et al......395/2
        5,357,596  10/94  Takebayashi, et al.395/2.84--.
```

AT [56], OTHER PUBLICATIONS,

Line 3, "fro" should read --for--.

COLUMN 1,

Line 20, "character))," should read --character),--.

Line 49, "refuse" should read --"Refuse"--.

COLUMN 2,

Line 5, "of" should be deleted.

Line 22, "in" should be deleted.

UNITED STATES PATENT AND TRADEMARK OFFICE

CERTIFICATE OF CORRECTION

PATENT NO. : 5,809,467

DATED : September 15, 1998

INVENTOR(S) : MITSURU OTSUKA, ET AL.

It is certified that error appears in the above-identified patent and that said Letters Patent is hereby corrected as shown below:

COLUMN 3,
Line 64, "converts" should read --converts a--.

COLUMN 4,
Line 19, "show" should read --show--.

COLUMN 5,
Line 7, "keyboard 109" should read --keyboard 109,--.
Line 47, "processing" should read --processing operation--.

COLUMN 6,
Line 22, "Thus-inputted" should read --Thus inputted--.
Line 37, data, however;" should read --data; however,--.
Line 42, "document," should read --document--.
Line 49, "difference" should read --different--.

COLUMN 7,
Line 39, "displaying" should read --displaying of--; and
Line 40, "storing" should read --storing of--.

COLUMN 8,
Line 12, "and" should be deleted.
Line 31, "(the)" should be deleted.

UNITED STATES PATENT AND TRADEMARK OFFICE

CERTIFICATE OF CORRECTION

PATENT NO. : 5,809,467

DATED : September 15, 1998

INVENTOR(S) : MITSURU OTSUKA, ET AL.

It is certified that error appears in the above-identified patent and that said Letters Patent is hereby corrected as shown below:

COLUMN 11,
Line 4, "display" should read --displaying--.
Line 51, "character," should read --characters,--.

COLUMN 12,
Line 24, "displaying" should read
--displaying one or more--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*